United States Patent [19]

Choy

[11] Patent Number: 4,753,329

[45] Date of Patent: Jun. 28, 1988

[54] MULTI-COMPARTMENTED BAG CONSTRUCTION

[76] Inventor: George Y. W. Choy, 1076 Illima Dr., Honolulu, Hi. 96817

[21] Appl. No.: 93,268

[22] Filed: Sep. 4, 1987

[51] Int. Cl.[4] ..... A45C 3/12; A45C 7/00; A45C 11/26; A45C 13/00

[52] U.S. Cl. ..... 190/111; 190/107; 206/278; 206/315.1; 383/39; 383/40

[58] Field of Search ..... 383/37, 39, 40, 4, 38; 190/107, 109, 110, 111, 112; 206/278, 287, 287.1, 315.1, 315.11; 150/112, 117

[56] References Cited

U.S. PATENT DOCUMENTS

| | | | |
|---|---|---|---|
| 185,181 | 12/1876 | Keeney | 190/111 |
| 503,355 | 8/1893 | Phillips | 383/39 X |
| 1,176,598 | 5/1916 | Pollgreen | 190/111 |
| 2,423,297 | 7/1947 | Creamer | 206/287.1 X |
| 2,754,867 | 7/1956 | Langer | 383/39 X |
| 3,061,057 | 10/1962 | Miller | 190/111 X |
| 3,139,133 | 6/1964 | Spector | 383/39 X |
| 3,221,959 | 12/1965 | Southwick | 383/40 X |
| 3,292,747 | 12/1966 | Dawson | 190/111 X |
| 3,352,391 | 11/1967 | Vaughan | 190/111 |
| 3,448,839 | 6/1969 | Lugash | 206/287 |
| 3,530,961 | 9/1970 | Weissenbach | 190/111 |
| 3,777,862 | 12/1973 | Zipper | 190/107 |
| 3,929,224 | 12/1975 | Smith, Jr. | 206/287 |
| 4,693,344 | 9/1987 | Shuler | 190/111 X |

FOREIGN PATENT DOCUMENTS

| | | | |
|---|---|---|---|
| 3602216 | 2/1987 | Fed. Rep. of Germany | 190/109 |
| 311 | of 1898 | United Kingdom | 190/111 |
| 2107974 | 5/1983 | United Kingdom | 383/40 |

*Primary Examiner*—William Price
*Assistant Examiner*—Sue A. Weaver
*Attorney, Agent, or Firm*—Henderson & Sturm

[57] ABSTRACT

A multi-compartment bag construction (10) comprising a bag unit (11) including a waterproof inner wall member (16) and an outer wall member (15) provided with a strap member (13) having securing means (21) and a handle member (14) wherein the outer (15) and inner (16) wall members are connected together to form a plurality of individual compartment elements (19) having their own closure members (30); wherein the strap member (13) is adapted to bring the individual compartments (19) into contact with one another to produce a generally barrel shaped bag configuration for the bag construction.

12 Claims, 1 Drawing Sheet

FIG. 5.
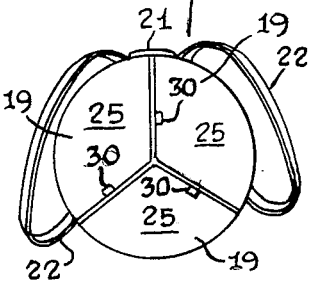
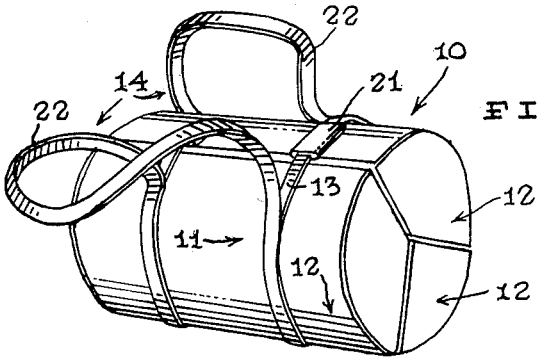
FIG. 1.
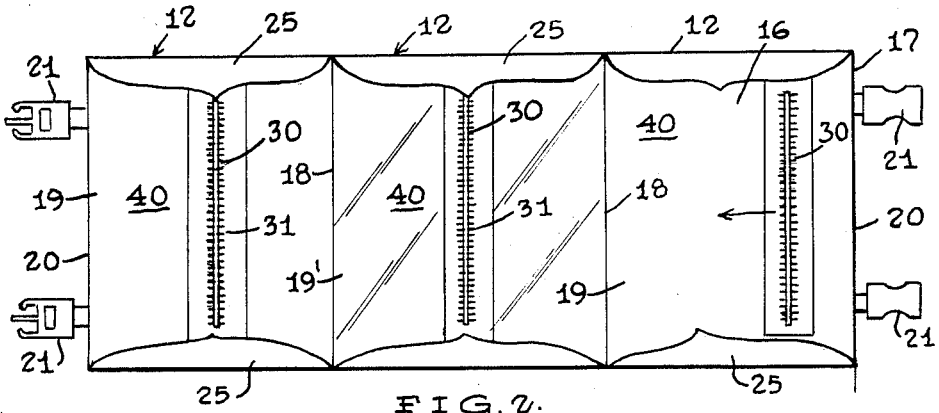
FIG. 2.
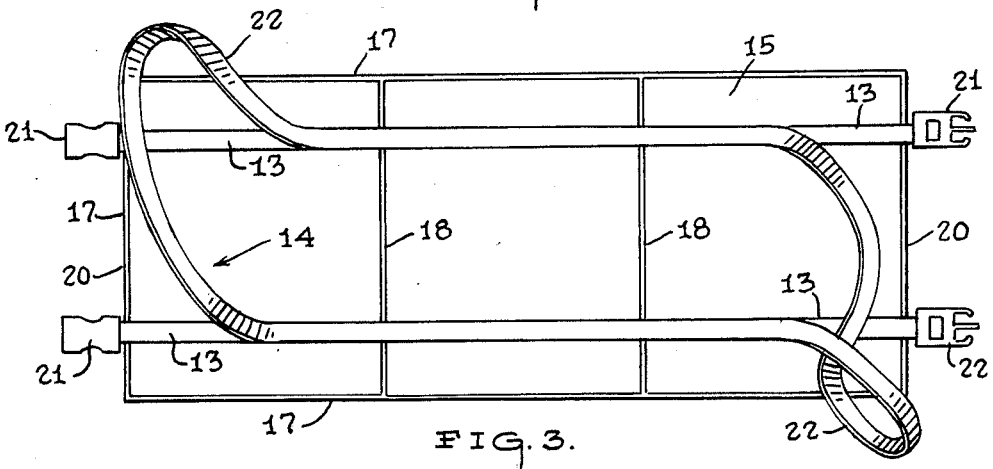
FIG. 3.
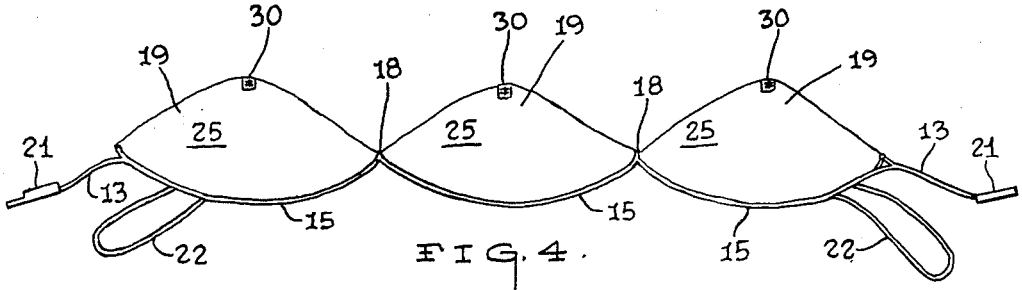
FIG. 4.

MULTI-COMPARTMENTED BAG CONSTRUCTION

TECHNICAL FIELD

The present invention relates generally to the field of multi-compartment luggage and the like.

BACKGROUND OF THE INVENTION

As can be seen by reference to the following U.S. Pat. Nos: 3,352,391; 3,061,057; 3,292,747; and 3,530,961, the prior art is replete with myriad and diverse multi-compartment hand luggage arrangements.

As can also be seen by reference to the aforementioned patents the prior art may be broken down into one or more of the following classifications: lateral stacking, vertical stacking, and/or foldable. While all of these prior art devices are more than adequate for their intended purpose and function, they are also deficient in a number of individual respects.

For example, both the vertically and laterally stackable constructions are generally difficult to assemble, employ complex and costly cooperating fastening means, and produce a generally cumbersome and bulky arrangement in their fully assembled mode.

In addition, the foldable versions are normally dimensioned, designed and configured to only readily accept generally elongated flat articles of clothing and the like, and the foldable versions are also usually designed to function as hanging garment bags or similar items.

It should also be noted that all of the different types of multi-compartment arrangements described so far have been designed for general usage, and none of them have been concerned with any particular type of specialized environment that would require an external and/or internal structural modification to the basic luggage carrier configuration.

Bearing the foregoing facts in mind and taking into consideration the fact that this country has experienced a recent upsurge, if not a growing national obsession with physical fitness; it comes as somewhat of a surprise that significant structural modifications have not appeared in what would commonly be termed as a gym bag construction.

While some gym bags have been provided with waterproof linings and compartments to segregate wet and/or dirty clothing, towels, etc. from other items, these minor modifications still do not provide an answer to the many problems affecting the users of a conventional gym bag construction.

BRIEF SUMMARY OF THE INVENTION

The present invention was specifically developed to provide a multi-compartment gym bag construction that would accommodate and segregate the users clothing and/or equipment into distinct waterproof storage compartments.

In addition, the multi-compartment bag construction that forms the basis of the present invention was based on a conventional barrel configuration gym bag construction, which was modified and improved upon from both a functional and a structural standpoint.

Briefly stated, the multi-compartment bag construction of this invention comprises a bag unit having a plurality of distinct envelope compartments which are hingedly secured to one another and provided with their own independent closure means.

In addition, the bag unit is provided with aligned handle members and strap members having releasable securing means, wherein the strap and handle members cooperate with the plurality of envelope compartments to secure and support the bag unit in a barrel bag configuration.

Furthermore, at least one of the interior panels of the compartments is fabricated of transparent material and all of the compartments are provided with their own independent closure means, such that the contents of each of the compartments becomes both readily accessible and at least partially visible to the user once the releasable securing means of the bag unit have been disengaged; and, the bag unit may subsequently be suspended in a vertical orientation within a locker or the like, so that the contents of each compartment are supported above the floor of the locker and within easy reach of the user.

BRIEF DESCRIPTION OF THE DRAWINGS

These and other objects, advantages, and novel features of the invention will become apparent from the detailed description of the best mode for carrying out the preferred embodiment of this invention which follows, particularly when considered in conjunction with the accompanying drawings, wherein:

FIG. 1 is a perspective view of the bag construction of this invention in its closed disposition;

FIG. 2 is a top plan view of the interior of the bag construction in an open disposition;

FIG. 3 is a bottom plan view of the exterior of the bag construction in an open disposition;

FIG. 4 is an end view of the bag construction in an open disposition; and,

FIG. 5 is a perspective view of the end of the bag construction in it s closed disposition.

BEST MODE FOR CARRYING OUT THE INVENTION

As can be seen by reference to the drawings and in particular to FIG. 1, the multi-compartment bag construction that forms the basis of the present invention is designated generally by the reference numeral (10). The bag construction (10) comprises in general: a bag unit (11) including a plurality of envelope receptacles (12) operatively attached to at least one strap member (13) and at least one handle member (140. The aforementioned structural components will now be described in seriatim fashion.

In the preferred embodiment of this invention illustrated in FIGS. 1 thru 5, it can be seen that the multi-compartment bag construction (10) comprises a triple compartment bag with (11) wherein the bag unit (11) comprises a generally elongated rectangular outer envelope wall member (15) and a generally elongated rectangular inner envelope wall member (16).

As can best be seen by reference to FIGS. 2 thru 4, the inner (16) and outer (15) wall members are joined along their outer edges (17), and the plurality of envelope receptacles (12) are formed by joining elongated strips (18) of the inner (16) and outer (15) wall members at spaced generally parallel locations along the length of the bag unit (11) to form the inner and outer walls of individual compartment elements (19).

As shown in FIG. 3, the outer wall member (15) of the bag unit (11) is provided with a plurality of strap members (13) which project slightly beyond the outboard edges (20) of the bag unit (11), and which are provided with complimentary releasable securing means (21) on their opposite ends, whose purpose and function will be described presently.

As can also be seen by reference to FIG. 3, the outer wall member (15) of the bag unit (11) is further provided with a handle member (14) having a pair of handle loops (22) which project substantially beyond the outboard edge (20) of the bag unit (11).

Turning now to FIG. 2, it can be seen that each of the individual compartment elements (19) that form the plurality of envelope receptacles (12) are provided with their own closure means (30) which are disposed on the inner wall member (16) of the bag unit (11). The closure means (30) of the preferred embodiment comprise zipper members (31) which control the access to the interior of each compartment element (19) in a well recognized manner; however, other suitable closure means (30) could be substituted in keeping with the teachings of this invention.

As was mentioned earlier on in the specification, the multi-compartment bag construction (10) of this invention was designed primarily as a gymnasium bag. Bearing that fact in mind it should be emphasized that the inner envelope wall member (16) must be fabricated from a waterproof material (40), such as plastic or vinyl.

It should also be noted that the material (40) must be capable of being manufactured as an opaque and/or transparent sheet, in as much as, at least one of the compartment elements (19') of the bag construction (10) is intended to have a transparent inner wall, such that the contents of at least one of the compartments (19) will be visible when the bag unit is disposed as in FIG. 2.

While the outer envelope wall member (15) may also be fabricated from a waterproof material (40), this invention does not necessarily require that characteristic in all instances. In fact, under certain circumstances it would be preferable to have the outer envelope wall member (15) fabricated from a microporous material, such as is manufactured under the trademark GORE-TEX; wherein, water droplets cannot pass through the outer envelope wall member (15) yet water vapor and air may escape from within the interior of the compartments (19).

At this point it should also be emphasized that while the basic bag construction (10) has been essentially set forth herein, there are two distinct ways that the bag construction (10) may be fabricated to achieve the barrel configuration illustrated in the various drawings.

As described thus far, each of the individual compartments (19) may be fabricated merely by joining the opposed peripheral edges of the inner and outer envelope wall members (16)(15). However, in order to achieve the desired enlarged capacity of each compartment it will be necessary to enlarge the configuration of one of the envelope wall members relative to the other to allow for the expansion of the interior of the compartments (19).

In the other instance the inner and outer envelope wall members (16) and (15) are provided with arcuate end panel segments (25), wherein the inner and outer envelope wall members (16)(15) form the top and bottom of the compartments (19) and the end panel segments (25) form the sides of the compartments (19).

As can best be seen by reference to FIGS. 1 and 5, once the cooperating securing means (21) on the strap members (13) are operatively engaged, the plurality of envelope receptacles (12) come into contact with one another to produce a generally barrel shaped bag construction (10); wherein the handle loops (22) function in their normal manner. However, when the cooperating securing means (21) of the strap members (13) are disengaged, the handle loops (22) may be used to suspend the bag construction (10) in a vertical orientation from either end.

In the embodiment illustrated in FIG. 2, all of the closure means (30) are centrally disposed relative to their individual compartments (19). However, as shown in FIGS. 2 and 5, one or more of the closure means (30) may be off-set relative to the center of its individual compartment (19); whereby the off-set closure means (30) will be covered by the waterproof material of an opposed compartment (19) when the bag construction (10) is closed.

Having thereby described the subject matter of this invention, it should be apparent that many substitutions, modifications, and variations are possible in light of the above teachings. It is therefore to be understood that the invention as taught and described herein is only to be limited to the extent of the breadth and scope of the appended claims.

I claim:

1. A multi-compartment construction comprising:

a bag unit comprising a generally elongated rectangular inner wall member fabricated from a waterproof material and a generally elongated rectangular outer wall member having at least one strap member and at least one handle member connected to, and projecting beyond the outboard edges of the said outer wall member; wherein the ends of said at least one strap member are provided with cooperating securing means; and, wherein the inner and outer wall members are connected along their outboard edges and at spaced generally parallel locations along the length of the bag unit to create a plurality of envelope receptacle comprising individual compartment elements.

2. The bag construction as in claim 1, wherein each of the individual compartment elements is provided with a closure means.

3. The bag construction as in claim 2, wherein the closure means are centrally disposed relative to the individual compartment elements.

4. The bag construction as in claim 2, wherein at least one of the closure means is centrally off-set relative to its respective individual compartment elements.

5. The bag construction as in claim 2, wherein the inner wall member of one of said plurality of envelope receptacles is fabricated from a transparent waterproof material.

6. The bag construction as in claim 5, wherein the inner wall member of one of said plurality of envelope receptacles is fabricated from an opaque waterproof material.

7. The bag construction as in claim 2, wherein the inner and outer wall members of each of said individual compartment elements are provided with arcuate end panel segments.

8. The bag construction as in claim 2, wherein the said at least one strap member having cooperating securing means is adapted to bring the said plurality of envelope receptacles into engagement with one another to produce a generally barrel shaped bag configuration.

9. The bag construction as in claim 2, wherein the said closure means are formed on the inner wall member of said bag unit.

10. The bag construction as in claim 2, wherein one of said inner and said outer wall members is dimensioned larger than the other one.

11. The bag construction as in claim 2, wherein the bag unit is provided with a plurality of strap members having cooperating securing means formed on their ends.

12. The bag construction as in claim 2, where said at least one handle member has a pair of handle loops.

* * * * *